US012601036B2

(12) United States Patent
Whelchel et al.

(10) Patent No.: US 12,601,036 B2
(45) Date of Patent: Apr. 14, 2026

(54) ALUMINUM ALLOY COMPRISING LITHIUM WITH IMPROVED FATIGUE PROPERTIES

(71) Applicant: CONSTELLIUM ISSOIRE, Issoire (FR)

(72) Inventors: Ricky Whelchel, Athens, OH (US); Mathieu Revil-Baudard, Fontaine (FR); Philippe Jarry, Grenoble (FR); Bernard Bes, Seyssins (FR); Fanny Mas, Grenoble (FR)

(73) Assignee: CONSTELLIUM ISSOIRE, Issoire (FR)

( * ) Notice: Subject to any disclaimer, the term of this patent is extended or adjusted under 35 U.S.C. 154(b) by 810 days.

(21) Appl. No.: 16/619,419

(22) PCT Filed: Jun. 5, 2018

(86) PCT No.: PCT/FR2018/051298
§ 371 (c)(1),
(2) Date: Dec. 4, 2019

(87) PCT Pub. No.: WO2018/224767
PCT Pub. Date: Dec. 13, 2018

(65) Prior Publication Data

US 2020/0165707 A1 May 28, 2020

(30) Foreign Application Priority Data

Jun. 6, 2017 (FR) ..... 1755031

(51) Int. Cl.
*C22C 21/16* (2006.01)
*C22C 21/18* (2006.01)
*C22F 1/057* (2006.01)

(52) U.S. Cl.
CPC ..... *C22C 21/18* (2013.01); *C22C 21/16* (2013.01); *C22F 1/057* (2013.01)

(58) Field of Classification Search
CPC ..... C22C 21/00; C22C 21/12; C22C 21/16; C22C 21/18; C22F 1/04; C22F 1/057
See application file for complete search history.

(56) References Cited

U.S. PATENT DOCUMENTS 4,801,339 A * 1/1989 Osborn ..... C22F 1/04 75/235
4,869,870 A * 9/1989 Rioja ..... C22C 21/06 148/439

(Continued)

FOREIGN PATENT DOCUMENTS

CN 105543595 A 5/2016
EP 2231888 B1 8/2014

(Continued)

OTHER PUBLICATIONS

Search Report and Written Opinion of French Patent Application No. 1755031 dated Apr. 4, 2018.

(Continued)

*Primary Examiner* — Vanessa T. Luk
(74) *Attorney, Agent, or Firm* — McBee Moore & Vanik IP, LLC

(57) ABSTRACT

An aluminium alloy comprising lithium with improved mechanical strength and toughness. The invention relates to a 2XXX wrought alloy product comprising from 0.05 to 1.9% by weight of Li and from 0.005 to 0.045% by weight of Cr and/or of V. The invention also relates to an as-cast 2XXX alloy product comprising from 0.05 to 1.9% by weight of Li and from 0.005 to 0.045% by weight of Cr and/or of V. Finally, the invention relates to an aircraft structure element, preferably a lower surface or upper sur- (Continued)

face element, the skin and stiffeners of which originate from the same starting material, a spar or a rib, comprising a wrought product.

10 Claims, 4 Drawing Sheets

(56) References Cited

U.S. PATENT DOCUMENTS

| | | | | |
|---|---|---|---|---|
| 5,066,342 | A * | 11/1991 | Rioja | C22F 1/04 148/438 |
| 9,670,567 | B2 | 6/2017 | Jarry | |
| 10,415,129 | B2 | 9/2019 | Danielou et al. | |
| 2005/0006008 | A1* | 1/2005 | Cho | C22C 21/16 420/533 |
| 2009/0142222 | A1 | 6/2009 | Colvin et al. | |
| 2011/0247730 | A1* | 10/2011 | Yanar | B22D 21/007 148/552 |
| 2011/0253266 | A1* | 10/2011 | Bush | C22F 1/057 148/550 |
| 2012/0152415 | A1* | 6/2012 | Danielou | C22C 21/12 148/552 |
| 2012/0237395 | A1* | 9/2012 | Jarry | C22B 21/06 164/416 |
| 2016/0115576 | A1 | 4/2016 | Long et al. | |
| 2016/0237532 | A1 | 8/2016 | Danielou et al. | |
| 2017/0306454 | A1 | 10/2017 | Chevy et al. | |

FOREIGN PATENT DOCUMENTS

| | | | |
|---|---|---|---|
| WO | 2012/110717 | A1 | 8/2012 |
| WO | 2015/086921 | A2 | 6/2015 |
| WO | 2016/051099 | A1 | 4/2016 |

OTHER PUBLICATIONS

The Aluminum Association, Inc., "International alloy designations and chemical composition limits for wrought aluminium and wrought aluminium alloys", Registration Record Series, Feb. 2014, XP055136121, Retrieved from the Internet: URL: http://www.aluminum.org/sites/default/files/Teal_Sheets.pdf.

"Aluminum alloy 2055-T84 Extrusions", Arconic Product Catalog, 2016, pp. 1-2, XP002779460, Retrieved from the Internet: URL:https://www.arconic.com/adip/catalog/AFE2055-factsheet.pdf.

"Alloy 2099-T83 and 2099-T8E67 Extrusions", Arconic Product Catalog, Aug. 2005, pp. 1-2, XP002779461, from the internet URL:https://www.arconic.com/hard_alloy_extrusions/catalog/pdf/Alloy2099TechSheet.pdf.

Starke, E.A. et al., "Application of modern aluminum alloys to aircraft", Progress in Aerospace Sciences, 1996, pp. 131-172, vol. 32, No. 2.

Blankenship, C.P. et al., "Structure-property relationships in Al—Li—Cu—Mg—Ag—Zr alloy X2095", Acta Metallurgica & Materialien, Mar. 1994, pp. 845-855, vol. 42, No. 3.

Warner, Timothy, "Recently-Developed Aluminium Solutions for Aerospace Applications", Materials Science Forum, Jul. 15, 2006, pp. 1271-1278, vol. 519-521.

Blankenship, C.P. et al., "Improved toughness in Al—Li—Cu—Mg—Ag—Zr alloy X2095", Scripta Metallurgica et Materialia, 1992, pp. 1719-1722, vol. 26, No. 11.

Rioja, Roberto J. et al., "The Evolution of Al—Li Base Products for Aerospace and Space Applications", Metallurgical and Materials Transactions A, Mar. 31, 2012, pp. 3325-3337, vol. 43, No. 9.

International Search Report of International Patent Application No. PCT/FR2018/051298 dated Sep. 11, 2018.

N. Eswara-Prasad, et al., "Aluminum-Lithium 10 Alloys: Processing, Properties, and Applications", Aviation Industry Press, (2016), pp. 147.

Wang Xiaomin, "Engineering Materials", China Machine Press, (1999), pp. 211.

Lequeu, et al., "Aluminum-Copper-Lithium Alloy 2050 Developed for Medium to Thick Plate," Journal of Materials Engineering and Performance, v. 19(6), pp. 841-847 (Aug. 2010).

Kashaev, et al., "Development of Laser Beam Welding Concepts for Fuselage Panels," Challenges in European Aerospeace, 5th CEAS Air & Space Conference (Copyright © 2015).

Calogero, et al., "A Weldability Study of Al—Cu—Li 2198 Alloy," Metallurgist, vol. 57, Nos. 11-12 (Mar. 2014).

* cited by examiner a)

b)

c)

a)

b)

c)

ALUMINUM ALLOY COMPRISING LITHIUM WITH IMPROVED FATIGUE PROPERTIES

CROSS-REFERENCE TO RELATED APPLICATIONS

This application is a National Stage entry of International Application No. PCT/FR2018/051298, filed 5 Jun. 2018, which claims priority to European Patent Application No. 1755031, filed 6 Jun. 2017.

BACKGROUND

Field of the Invention

The invention relates to products made from 2XXX alloy with an aluminum base comprising lithium, more particularly, such products, the method of manufacture and of use, intended in particular for aeronautical and space construction.

Description of Related Art

Products made from aluminum alloy are developed in order to produce structural elements intended in particular for the aeronautical industry and the space industry.

Aluminum-lithium alloys are particularly promising for manufacturing this type of product. The specifications imposed by the aeronautical industry for fatigue resistance are high and are particularly difficult to achieve for thick products. Indeed, in light of the possible thicknesses of the cast ingots, the reduction in thickness by hot working is rather low and consequently the sites linked to casting on which fatigue cracks are initiated have their size only slightly reduced during the hot working.

Al—Li alloys offer compromises in properties that are generally higher than conventional alloys, in particular in terms of the compromise between fatigue, tolerance to damage and mechanical strength. This makes it possible in particular to reduce the thickness of the Al—Li wrought alloy products, thus further maximizing the reduction in weight that they provide. The current stresses are however increased, thus inducing higher risks of the initiation of fatigue cracks. It is therefore interesting to improve the resistance to fatigue of products made from Al—Li alloy.

In application WO 2012/110717, it is proposed in order to improve the properties, in particular in fatigue, aluminum alloys containing in particular at least 0.1% of Mg and/or 0.1% of Li for carrying out during the casting an ultrasound treatment. However this type of treatment requires a substantial modification to the casting furnace and remains difficult to carry out for the quantities required for the manufacture of plates.

Application US 2009/0142222 describes alloys that can comprise 3.4-4.2% by weight of Cu, 0.9-1.4% by weight of Li, 0.3-0.7% by weight of Ag, 0.1-0.6% by weight of Mg, 0.2-0.8% by weight of Zn, 0.1-0.6% by weight of Mn and 0.01-0.6% by weight of at least one element that controls the granular structure, with the remainder being aluminum, incidental elements and impurities.

Application WO 2015/086921 describes alloys comprising, as a % by weight, Cu: 2.0-6.0; Li: 0.5-2.0; Mg: 0-1.0; Ag: 0-0.7; Zn 0-1.0; and at least one element chosen from among Zr, Mn, Cr, Sc, Hf and Ti, the quantity of said element, if it is chosen, being from 0.05 to 0.20% by weight for Zr, 0.05 to 0.8% by weight for Mn, 0.05 to 0.3% by weight for Cr and for Sc, 0.05 to 0.5% by weight for Hf and from 0.01 to 0.15% by weight for Ti, with the remainder being aluminum, incidental elements and impurities.

Generally, the Al—Cu—Li alloys are known by "International alloy designations and chemical composition limits for wrought aluminum and alloy" published by The Aluminum Association. Known for example are the AA2050, AA2055, AA2098, AA2099 alloys. However in none of the known alloys is carried out an addition of Cr and/or of V from 0.005 to 0.045% by weight.

There is a need for products made from Al—Li allow that have improved properties in relation to those of known products, in particular in terms of properties in fatigue while still having advantageous toughness properties and static mechanical strength properties. Moreover, there is a need for a simple and economical method for obtaining these products.

SUMMARY

The invention has for object a rolled, extruded and/or forged product in 2XXX alloy with an aluminum base comprising from 0.05 to 1.9% by weight of Li and from 0.005 to 0.045% by weight of Cr and/or of V.

According to an embodiment, said wrought product according to the invention has an average density d of intermetallic phases, expressed as a number of phases per $mm^2$, such that $$d<-0.0023e^2+0.0329e+160.91$$

with e=thickness of the product in mm.

Advantageously, said wrought product does not substantially contain any dispersoids with V and/or Cr.

The invention also has for object a 2XXX cast alloy product with an aluminum base comprising from 0.05 to 1.9% by weight of Li and from 0.005 to 0.045% by weight of Cr and/or V. Said cast product has grains that are more dendritic with respect to those of a cast alloy product of the same composition except for its content in V and Cr.

Finally, the invention has for object an aircraft structural element, more preferably a bottom surface or upper surface element of which the skin and the stiffeners come from the same starting product, a spar or a rib, comprising an aforementioned rolled, extruded and/or forged product.

BRIEF DESCRIPTION OF THE DRAWINGS

(FIG. 1*a*: alloy C, FIG. 1*b*: alloy A and FIG. 1*c*: alloy B)

(FIG. 2*a*: alloy C, FIG. 2*b*: alloy A and FIG. 2*c*: alloy B)

DETAILED DESCRIPTION OF A PREFERRED EMBODIMENT

Figure 1:
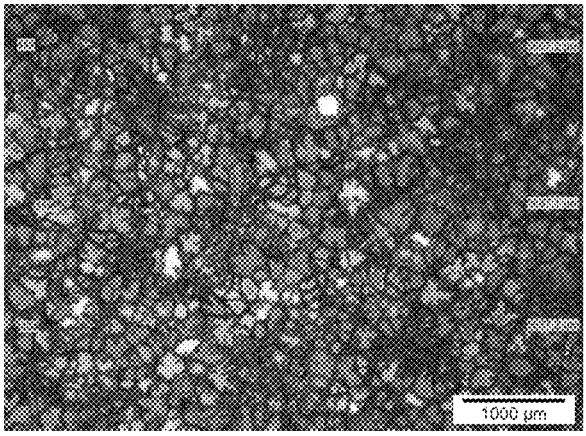
FIG. 1 shows micrographs obtained for the samples taken at mid-thickness of the cast ingots made of an alloy according to the example 1
Figure 1:
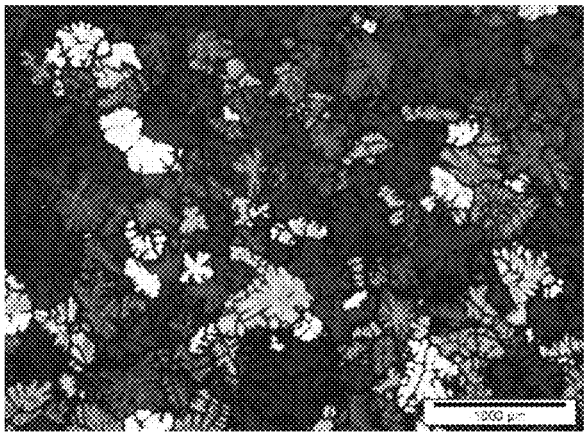
Figure 1:
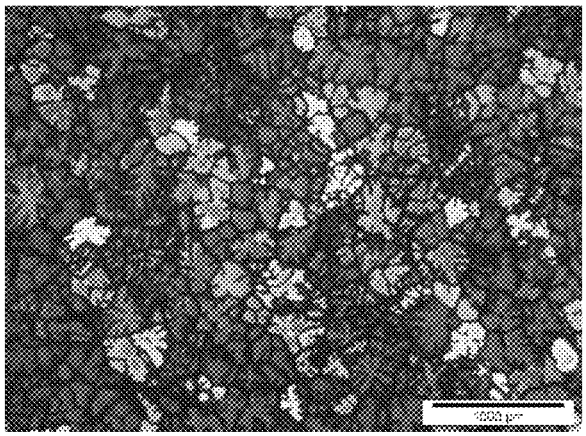

Unless mentioned otherwise, all of the indications regarding the chemical composition of the alloys are expressed as a percentage by weight based on the total weight of the alloy. The expression 1.4 Cu means that the copper content expressed in % by weight is multiplied by 1.4. The designation of the alloys is done in accordance with the regulations of The Aluminum Association, known to those skilled in the art. When the concentration is expressed in ppm (parts per million), this indication also refers to a mass concentration.

Unless mentioned otherwise, the definitions of the tempers indicated in the European standard EN 515 (1993) apply.

Unless mentioned otherwise, the definitions of the standard EN 12258 apply. The thickness of the profiles is defined according to the standard EN 2066:2001: the transverse section is divided into elementary rectangles of dimensions A and B; A always being the largest dimension of the elementary rectangle and B able to be considered as the thickness of the elementary rectangle.

The static mechanical characteristics in tensile, in other terms the ultimate tensile strength $R_m$, the conventional yield strength to 0.2% of elongation $R_{p0.2}$, and the elongation at rupture A %, are determined by a tensile test according to the standard NF EN ISO 6892-1 (2016), the sampling and the direction of the test being defined by the standard EN 485 (2016).

The stress intensity factor ($K_{1C}$) is determined according to the standard ASTM E 399 (2012).

The properties in fatigue on test pieces with a hole are measured in ambient air for variable levels of stress, at a frequency of 50 Hz, a stress ratio R=0.1, on flat test pieces (Kt=2.3) in the direction L-T according to the standard EN 6072 (2010).

The Walker equation was used to determine a maximum stress value representative of 50% of non-rupture at 240,000 cycles. To do this a fatigue quality index (FQI) is calculated for each point on the Wohler curve, representing the relationship between the amplitude of stresses applied S and a number of cycles N, with the formula:

$$S=S_{lim}+(\mathrm{FQI}-S_{lim})(N/N_0)^{1/p}$$

where S is the stress amplitude applied, $S_{lim}$ is the endurance limit, N is the number of cycles until rupture, No is equal to 240,000 and p an exponent. The corresponding FQI is compared to the median, i.e. 50% of rupture for 240,000 cycles. The meaning of the FQI is in particular described in the article "Démarches de calcul en fatigue dans le domaine aéronautique (structures métalliques)" (Duprat, D. (1999) Congrès "Dimensionnement en fatigue des structures: demarche and outils", Paris 2-3 Jun. 1999; Societe Française de Métallurgie et de Matériaux. Journées de printemps No. 18, Paris, France (Feb. 6, 1999), pp. 2.1-2.8).

In the framework of the invention, the casting microstructure is in particular characterized by the parameters, p* (dimension [μm) and s* (dimension [$\mu m^{-1}$]). These parameters characterize more particularly the finesse and the uniformity of the microsegregation. The parameter p* characterizes the average distance between precipitates in the solidification structures, and therefore the average dimension of the areas devoid of precipitates. The parameter s* characterizes the uniformity of the distribution of these distances. The exact definition of these two parameters as well as the method for determining them are stated in the article "Quantification of Spatial Distribution of as-cast Microstructural Features" by Ph. Jarry, M. Boehm and S. Antoine, published in Proceedings of the Light Metals 2001 Conference, Ed. J. L. Anjier, TMS, p. 903-909. The determination of the parameter p* was the subject of an interlaboratory test in the framework of the European project VIRCAST, see the article by Ph. Jarry and A. Johansen "Characterisation by the p* method of eutectic aggregates spatial distribution in 5xxx and 3xxx aluminum alloys cast in wedge molds and comparison with SDAS measurements", published in Solidification of Alloys, ed. M. G. Chu, D. A. Granger and Q. Han, T M S 2004. The parameters p* and s* are based on the analysis via optical microscopy of polished sections of the wrought form at a magnification typically of 50, or any other enlargement that provides a good compromise between a sampling that is representative of the studied microstructure and the required resolution. The acquisition of the images is typically carried out by a color camera of the CCD (charge-coupled device) type, connected to an image analysis computer. The analysis procedure, described in detail in the aforementioned article by Ph. Jarry, M. Boehm and S. Antoine, comprises the following steps:

a. acquisition of the image
b. thresholding of the dark phases and binary analysis of the images that have gray levels,
c. suppression of the very small size phases (for an enlargement of 50, a group of less than 5 pixels is considered as electronic noise),
d. digital analysis of the image using a closing algorithm.

The digital analysis of the image consists in an iterative closing of the image with an increasing step. The step i that closes the image $C_i$ is defined by i successive dilatations of the image of the same object (a dilatation consisting in the replacing of each pixel of an image with the maximum value of its neighbors) followed by i successive erosions of the image of the same object (an erosion consisting in the replacing of each pixel of an image with the minimum value of its neighbors) of the image d, (note that the operations of erosion and of dilatation are not commutative). The surface ratio A, which represents the surface fraction of the objects, is plotted according to the number of closing steps i. A sigmoidal curve is obtained, which is then adjusted by a sigmoidal function in order to extract therefrom the characteristic parameters p* and s*, knowing that p* is the abscissa of the inflection point, expressed in units of length, and s* the slope at the inflection point of the sigmoidal curve.

The parameter p* is thus defined by the equation:

$$A = A\min + \frac{A\max + A\min}{(1+\exp(\alpha(p*-i)))}$$

wherein

A designates the surface fraction of objects after transformation, $A_{min}$ designates the initial surface fraction of intermetallic particles after thresholding, $A_{max}$ designates their surface fraction that corresponds to the conventional filling at which the algorithm is stopped (in practice 90%) in order to prevent the problems of slow convergence at the end of filling, i is the number of calculation steps, and $\alpha$ is an adjustment coefficient of the slope of the sigmoid.

The parameter p* represents the average distance between particles present in the matrix.

The other parameter is s* defined by the equation:

$$s = s\frac{\alpha \times (A\max - A\min}{4}$$

It has been shown that 1/s* is proportional to the standard deviation of the distribution of the distances to the first neighbor between particles. The parameter s* is therefore a measurement of the regularity of the distribution of the phases in the matrix.

The description of the casting structure by the parameters s* and p* therefore does take account of both the finesse and the uniformity of the microsegregation. The applicant has observed that s* is more significant for describing the regularity of the distribution of particles, while p* is more significant for describing the finesse of their spatial distribution.

Figure 2:
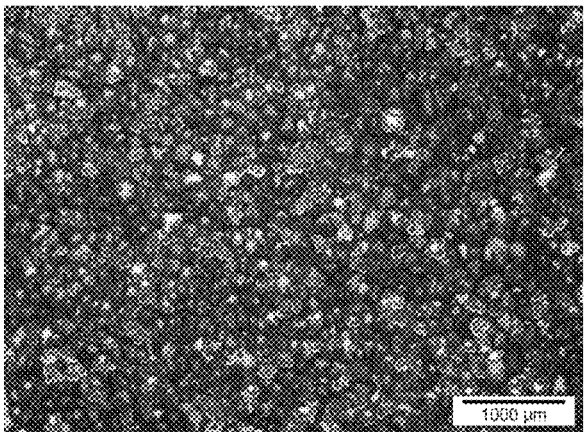
FIG. 2 shows micrographs obtained for the samples taken at a quarter-thickness of the cast ingots made of an alloy according to the example 1
Figure 2:
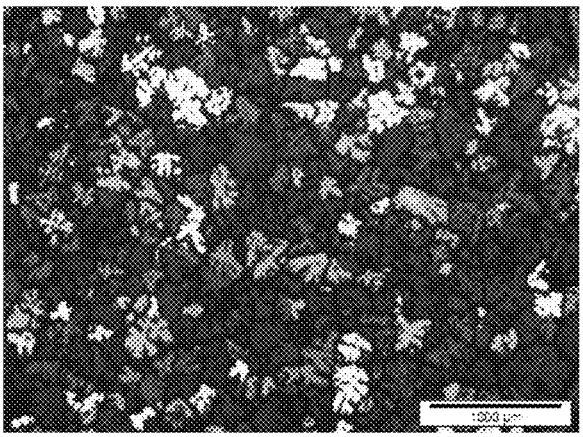
Figure 2:
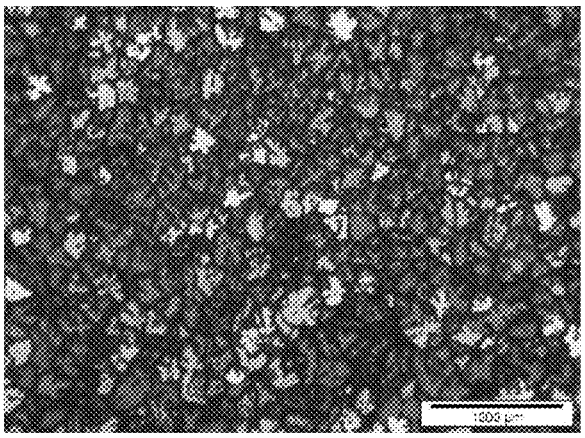

In the framework of the invention, the cast microstructure is also semi-quantitatively characterized according to a score from 0 to 2: score 0=mostly globular grains, score 1=grains slightly dendritic, score 2=grains highly dendritic. The semi-quantitative evaluation is carried out using micrographs of samples, taken at a quarter- or at mid-thickness of the cast ingots, after anodic oxidation (solution of diluted HBF4, open circuit voltage of 30V, etching time between 60 and 180 s). The example 1 (table 3, FIGS. 1 and 2) shows in detail the correspondence between a score 0, 1 or 2 such as described hereinabove and the micrographs. FIGS. 1*a* and 2*a* represent a score of 0, FIGS. 1*c* and 2*c* a score of 1 and FIGS. 1*b* and 2*b* a score of 2.

In the framework of the invention, the microstructure of wrought sheets is characterized at mid-thickness (t/2) and at a quarter-thickness (t/4) by scanning electron microscopy in order to determine the dispersion and the size of the intermetallic phases on a micrometric scale. The intermetallic phases, also known as "constituent particles" are insoluble phases formed during solidification, for example $Al_6$(FeMn), $CU_2FeAl_7$ or $FeAl_3$ phases. Their size is greater than 1 μm, typically between 2 and 50 μm.

Unless mentioned otherwise, the definitions of the standard EN 12258-1 (1998) apply. In particular, a sheet is according to the invention a rolled product with rectangular transverse section of which the uniform thickness is at least 6 mm and does not exceed 1/10 of the width.

The term "structural element" of a mechanical construction is here used to refer to a mechanical part for which the static and/or dynamic mechanical properties are particularly substantial for the performance of the structure, and for which a structure calculation is usually prescribed or carried out. This is typically elements of which the failure is likely to place in danger the safety of said construction, of its users, or other persons. For an aircraft, these structural elements include in particular the elements that comprise the fuselage (such as fuselage skin), fuselage stiffeners or stringers, bulkheads, circumferential frames, wings (such as wing skin), stiffeners or stringers, ribs and spars and the tailplane comprised in particular of horizontal or vertical stabilizers, as well as floor beams, seat tracks and doors.

The present inventors observed, surprisingly, that it is possible to obtain 2xxx alloy sheets with an aluminum base, i.e. an Al—Cu alloy that is according to the definition of The Aluminum Association of aluminum alloys of which the major additive element is copper and of which the additive element content is greater than 1% by weight, comprising lithium having an improved fatigue performance while still having advantageous toughness properties and static mechanical strength properties by selecting specific and critical quantities of chromium and/or of vanadium to said alloy, more particularly by specifically adding from 0.005 to 0.045% by weight of Cr and/or of V. Preferably the alloy according to the invention comprises from 0.010 to 0.044%, more preferably from 0.015 to 0.044% and, more preferably from 0.025 to 0.044% by weight of Cr and/or of V. In an even more preferred embodiment, the alloy comprises from 0.035 to 0.043% by weight of Cr and/or of V.

The vanadium and/or the chromium are generally added in aluminum alloys as elements that refine the grain or control elements of the structure of the grains in the same way as zirconium, scandium, hafnium, manganese or also the elements that belong to the family of rare earths. As such, the elements that refine the grain are generally added in quantities from 0.05 to 0.5% by weight in such a way as to form dispersoids during the steps of homogenization and those of heating. Dispersoids have in particular for role to prevent the migration of the grain boundaries and dislocations during the steps of later methods. This prevents in particular the recrystallization during the steps such as the solution heat treatment. Dispersoids are fine precipitates that are formed during the high-temperature thermal operations. For example $ZrAl_3$, $Al_{12}(FeMn)_3Si$ and $Al_{12}Mg_2Cr$. Their size is less than 1 μm typically from 0.01 to 0.5 μm.

On the contrary, but without assuming any scientific theory whatsoever, the present inventors have observed that the adding of V and/or of Cr in specific and critical quantities according to the invention to a 2XXX alloy comprising from 0.05 to 1.9% of Li by weight does not induce the formation of dispersoids at the temperatures at which the steps of homogenization and of heating are carried out for this type of alloy (generally from 450 to 550° C.) but an entirely particular microstructure such that the wrought product does not substantially contain any dispersoids with Cr and/or with V. The term "not substantially any dispersoids with Cr and/or with V" means here a density of dispersoids with Cr and/or with V less than 0.1 dispersoid per $\mu m^2$, preferably less than 0.05 per $\mu m^2$.

The critical quantity of Li and of V and/or Cr contained in the 2XXX alloy according to the invention affects the microstructure of the cast product as well as that of the final wrought product and the present inventors have revealed improved properties of the products according to the invention in relation to those of known products, in particular in terms of fatigue properties. More particularly, and this in particular for products with a thickness from 12 to 175 mm, preferably from 30 to 140 mm, the present inventors have revealed an improvement in fatigue and also in toughness and static mechanical strength of the products according to the invention in relation to those of known products that have a similar composition except for the critical content in V and Cr.

The lithium content of the products according to the invention is from 0.05 to 1.9% by weight. Advantageously, the lithium content is from 0.5 to 1.5% by weight, more preferably from 0.7 to 1.2% by weight and, more preferably from 0.80 to 0.95% by weight.

In an advantageous embodiment, the alloy of the products according to the invention is a 2XXX alloy comprising from 1.0 to 6.0% by weight of Cu, preferably from 3.2 to 4.0% by weight of Cu.

A composition of the alloy of the products made from 2XXX alloy according to the invention is in % by weight:

Li: 0.05 to 1.9%;
Cu: 1.0 and 6.0%;
Cr and/or of V: 0.005 to 0.045;
Mg: 0.1-1.0;
Zr: 0-0.15;
Mn: 0-0.6;
Zn<0.8;
Ag: 0-0.5;
Fe+Si≤0.2;
at least one element able to contribute to the control of the grain size from among Hf, Ti and Sc or other rare earth, the quantity of the element, if it is chosen, being from 0.02 to 0.15% by weight, preferably 0.02 to 0.1% by weight for Sc and other rare earths; 0.02 to 0.5% by weight for Hf and from 0.01 to 0.15% by weight for Ti;
other elements≤0.05 each and ≤0.15 in total;
remainder aluminum.

In a preferred embodiment, the alloy of the products according to the invention further comprises magnesium. The magnesium content of the products according to the invention is then advantageously between 0.15 and 0.7% by weight and preferably between 0.2 and 0.6% by weight. Advantageously, the magnesium content is at least 0.30% by weight preferably at least 0.35% by weight and preferably at least 0.38% by weight. In another embodiment, the magnesium is between 0.30 and 0.40% by weight.

In a preferred embodiment, the alloy of the products according to the invention comprises less than 0.8% by weight of Zn, preferably less than 0.7% by weight of Zn.

Advantageously the zinc content is between 0.45 and 0.65% by weight which can contribute to reaching an excellent compromise between the toughness and the mechanical strength. In this particular embodiment, the alloy according to the invention advantageously comprises less than 0.15% by weight of Ag, preferably less than 0.1% by weight and even more preferably less than 0.05% by weight.

In another embodiment, the alloy according to the invention comprises less than 0.05% by weight of Zn. In this second embodiment, the alloy according to the invention advantageously comprises more than 0.2% by weight of Argent, preferably between 0.3 and 0.5% by weight of Ag and even more preferably between 0.3 and 0.4% by weight of Ag.

In a particular embodiment, the alloy of the products according to the invention further comprises from 0.07 to 0.15% by weight of Zr, preferably from 0.07 to 0.11% by weight of Zr and, more preferably from 0.08 to 0.10% by weight of Zr.

Advantageously, the manganese content of the products according to the invention is between 0.1 and 0.6% by weight, preferably 0.2 and 0.4% by weight, which makes it possible to improve the toughness without compromising the mechanical strength.

Advantageously, the sum of the iron content and of the silicon content is at most 0.20% by weight. Preferably, the iron and silicon contents are each at most 0.08% by weight. In an advantageous embodiment of the invention, the iron and silicon contents are at most 0.06% and 0.04% by weight, respectively.

In a preferred embodiment, the alloy also contains at least one element that can contribute the control of the grain size chosen from among Hf, Ti and Sc or other rare earth, the quantity of the element, if it is chosen, being from 0.02 to 0.15% by weight, preferably 0.02 to 0.1% by weight for Sc and other rare earths; 0.02 to 0.5% by weight for Hf and from 0.01 to 0.15% by weight for Ti. Preferably, between 0.02 and 0.10% by weight of Ti is chosen, advantageously between 0.02 and 0.04% by weight.

According to an embodiment of the invention, the 2XXX alloy with an aluminum base further comprises the aforementioned critical content of Cr and/or of V and from 0.05 to 1.9% by weight of Li, of Cu in a content advantageously between 1.0 and 6.0% by weight, and optionally, in % by weight:

Mg: 0.15-0.7;
Zr: 0.07-0.15;
Mn: 0.1-0.6;
Zn<0.8;
Ag: 0-0.5;
Fe+Si≤0.2;
at least one element able to contribute to the control of the grain size from among Hf, Ti and Sc or other rare earth, the quantity of the element, if it is chosen, being from 0.02 to 0.15% by weight, preferably 0.02 to 0.1% by weight for Sc and other rare earths; 0.02 to 0.5% by weight for Hf and from 0.01 to 0.15% by weight for Ti;
other elements≤0.05 each and ≤0.15 in total;
remainder aluminum.

According to an entirely preferred embodiment of the invention, the product is an alloy with an aluminum base comprising, as a % by weight, in addition to the aforementioned critical content of Cr and/or of V, Cu: 3.2-4.0; Li: 0.80-0.95; Zn: 0.45-0.70; Mg: 0.15-0.7; Zr: 0.07-0.15; Mn: 0.1-0.6; Ag: <0.15; Fe+Si≤0.20; at least one element from among Ti: 0.01-0.15; Sc: 0.02-0.1; Hf: 0.02-0.5; other elements≤0.05 each and ≤0.15 in total, remainder aluminum. According to another embodiment, the product according to the invention is made from an AA2050 alloy that comprises the aforementioned critical content of Cr and/or of V.

The method of manufacturing products according to the invention comprises the steps of elaborating a bath of liquid metal; casting; homogenization; rolling, forging and/or extrusion; solution heat treatment; quenching; stress relief and optionally aged. In a first step, a bath of liquid metal made of 2XXX alloy is elaborated with an aluminum base comprising from 0.05 to 1.9% by weight of Li and from 0.005 to 0.045% by weight of Cr and/or of V. The bath of liquid metal is then cast as an unwrought product typically a rolling ingot, a forging stock or an extrusion billet.

The microstructure of the product according to the invention differs from that of the products of prior art right from the casting step. The cast alloy product according to the invention has in particular grains that are more dendritic with respect to those of a cast alloy product of the same composition except for its specific and critical content in V and Cr.

The present inventors have evaluated the casting microstructure semi-quantitatively and have assigned a score from 0 to 2 to the samples studied according to the dendritization of the grains: score 0=mostly globular grains, score 1=grains slightly dendritic, score 2=grains highly dendritic. The semi-quantitative evaluation was conducted using micrographs of the samples after anodic oxidation (solution of diluted HBF4, open circuit voltage of 30V, etching time between 60 and 180 s). The cast alloy product according to the invention thus has grains that are more dendritic, corresponding to a score from 1 (alloy according to the invention containing Cr) to 2 (alloy according to the invention containing V) according to the evaluation mentioned hereinabove, with respect to those of a cast alloy product of the same composition except for its specific and critical content in V and Cr of which the score is 0. Advantageously, the cast product according to the invention has, at one-fourth the thickness of said product, a parameter s* greater than 1.0 $\mu m^{-1}$ and by a parameter p* less than 100 μm, wherein the parameter p* is defined by the equation $$A = A\min + \frac{A\max - A\min}{(1 + \exp(\alpha(p* - i)))}$$

and wherein the parameter is defined by the equation $$s* = \frac{\alpha \times (A\max - A\min}{4}$$

wherein

A designates the surface fraction of objects after transformation, $A_{min}$ designates the initial surface fraction of intermetallic particles after thresholding, $A_{max}$ designates their surface fraction that corresponds to the conventional filling at which the algorithm is stopped in order to prevent the problems of slow convergence at the end of filling, i is the number of calculation steps, and α is an adjustment coefficient of the slope of the sigmoid.

According to a preferred embodiment, the cast product has a cast grain size evaluated by the intercept-slope method between:

250 and 350 μm at mid-thickness and 175 and 275 μm at a quarter thickness.

The cast product is then advantageously homogenized at a temperature between 450° C. and 550° and preferably between 480° C. and 530° C. for a duration between 5 and 60 hours.

After homogenization, the cast product is in general cooled to ambient temperature before being heated for the purpose of being hot worked. The heating has for purpose to reach a temperature advantageously between 400 and 550° C. and, preferably, of about 500° C. allowing for the working of the unwrought product.

The hot working can be carried out by rolling, forging and/or extrusion. Preferably, the hot working is carried out by rolling and/or forging in such a way as to obtain a rolled and/or forged product of which the thickness is preferably of at least 12 mm, more preferably of at least 30 mm and even more preferably of at least 40 mm. The rolled and/or forged product further has a preferred thickness of at most 175 mm, more preferably of at most 140 mm and even more preferably of at most 110 mm.

The wrought product thus obtained is then solution heat treated by a heat treatment preferably between 490 and 550° C. for 15 min to 8 h, then quenched typically with water at ambient temperature. The product then undergoes a controlled stress relief, preferably by tensile and/or by compression, with a permanent working from 1 to 7% and preferably of at least 2%. Rolled products undergo more preferably a controlled tensile with a permanent working at least equal to 3.5%. The preferred tempers are the tempers T84 and T86, preferably T84. Known steps such as rolling, flattening, straightening, forming can optionally be carried out after solution heat treatment and quenching and before or after the controlled tensile.

An aging is optionally carried out comprising a heating at a temperature between 130 and 170° C. for 5 to 100 hours and preferably from 10 to 50 h.

The rolled, extruded and/or forged product according to the invention advantageously has an average density d of intermetallic phases, expressed as a number of phases per $mm^2$, such that:

$$d < -0.0023e^2 + 0.0329e + 160.91$$

and even more preferably $$d < -0.0023e^2 + 0.0329e + 140.26$$

with e=thickness of the product in mm.

According to an advantageous embodiment, the product according to the invention, in a rolled state, solution heat treatment, quenched temper, stress relieved, preferably by stretching, and aged has, for thicknesses between 12 and 175 mm, a fatigue quality index, FQI, at 240,000 cycles expressed in MPa such that:

$$FQI > -0.0886e + 177$$

with e=thickness of the product in mm;

even more preferably, the product has such a fatigue quality index, FQI, at 240,000 cycles (MPa) such that:

$$FQI > -0.0886e + 180.$$

According to this advantageous embodiment, the rolled and/or forged product has a thickness between 30 to 140 mm, more preferably from 40 to 110 mm and even more preferably between 40 and 75 mm.

According to an embodiment, the product according to the invention, in a rolled state, solution heat treatment, quenched temper, stress relieved, preferably by stretching, and aged having at least one, preferably at least two, and even more preferably three, of the compromises of the following improved properties with respect to an alloy product of the same composition except for its content in Cr and/or V:

Rp0.2 (L) and K1C (L-T),

Rp0.2 (TL) and K1C (T-L)

Rp0.2 (TC) and K1C (TC-L).

The alloy according to the invention is particularly intended for the manufacture of rolled and/or forged products and, more particularly, rolled products.

The products according to the invention can advantageously be used in structural elements, in particular aircraft structural element.

Using a structural element that incorporates at least one product according to the invention is advantageous, in particular for the aeronautical construction. The products according to the invention are particularly advantageous for the carrying out of machined products in the mass, such as in particular bottom surface or upper surface elements of which the skin and the stiffeners come from the same starting product, spars or ribs, as well as any other use wherein the present properties could be advantageous These aspects, as well as others of the invention are explained in more detail using the following illustrative and non-limiting examples.

EXAMPLES

Example 1

Ingots of a thickness of about 400 mm of which the composition is given in the table 1 were cast.

TABLE 1

Composition as a % by weight of the Al-Cu-Li alloys cast in the form of an ingot.

| Alloy | Si | Fe | Cu | Mn | Mg | Zn | Ti | Zr | Li | Ag | V | Cr |
|---|---|---|---|---|---|---|---|---|---|---|---|---|
| A | 0.02 | 0.03 | 3.60 | 0.38 | 0.34 | — | 0.03 | 0.08 | 0.92 | 0.36 | 0.04 | — |
| B | 0.02 | 0.04 | 3.60 | 0.35 | 0.34 | — | 0.03 | 0.08 | 0.93 | 0.37 | — | 0.04 |
| C (2050) | 0.03 | 0.04 | 3.60 | 0.38 | 0.33 | — | 0.03 | 0.09 | 0.90 | 0.35 | — | — |
| D (2050) | 0.03 | 0.04 | 3.50 | 0.35 | 0.33 | — | 0.04 | 0.08 | 0.92 | 0.35 | — | — |

Samples were taken at mid-thickness (t/2) and at a quarter-thickness (t/4) of certain cast ingots in order to measure the cast grain size and the parameters p* and s* that characterize the finesse and the uniformity of significant for describing the regularity of the distribution of particles while the parameter p* is more significant for describing the finesse of their spatial distribution. The results are presented in the table 2 and compared to the average values of a typical AA2050 alloy.

TABLE 2

Grain size and parameters s* and p* evaluated at mid-thickness (t/2) and at a quarter-thickness (t/4) of the cast ingots made of Al-Cu-Li alloys.

| | P* (μm) | | s* ($\mu m^{-1}$) | | Grain size (μm) | |
|---|---|---|---|---|---|---|
| Alloy | t/2 | t/4 | t/2 | t/4 | t/2 | t/4 |
| A | 58 | 53 | 1.3 | 1.5 | 305 | 212 |
| B | 81 | 76 | 1.1 | 1.2 | 281 | 215 |
| AA2050 | 120 | 115 | 0.68 | 0.82 | 200 | 150 |

The microstructure of these samples was also evaluated semi-quantitatively on the samples taken according to a score from 0 to 2: score 0=mostly globular grains, score 1=grains slightly dendritic, score 2=grains highly dendritic. The semi-quantitative evaluation was conducted using micrographs of the samples after anodic oxidation (solution of diluted HBF4, open circuit voltage of 30V, etching time between 60 and 180 s).

Figure 3:
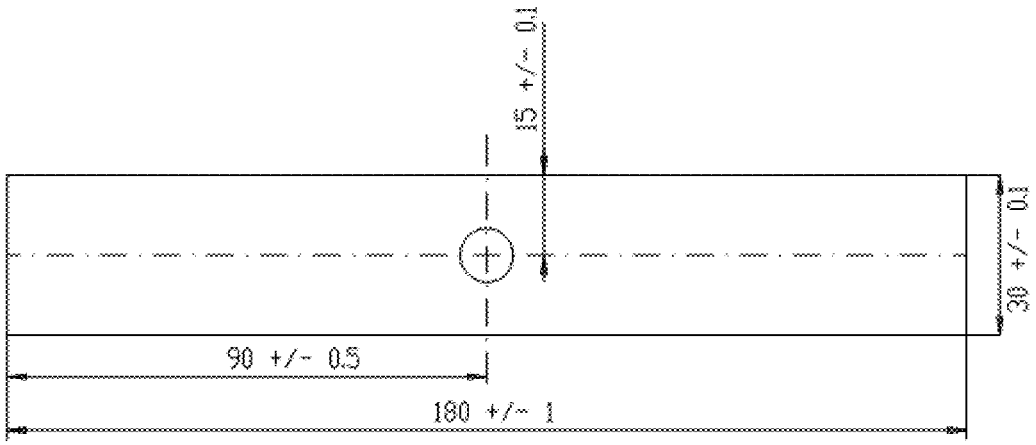
FIG. 3 is the diagram of the test pieces used for fatigue with holes. The dimensions are mentioned for the purposes of information but can vary as indicated in the description.
Figure 4:
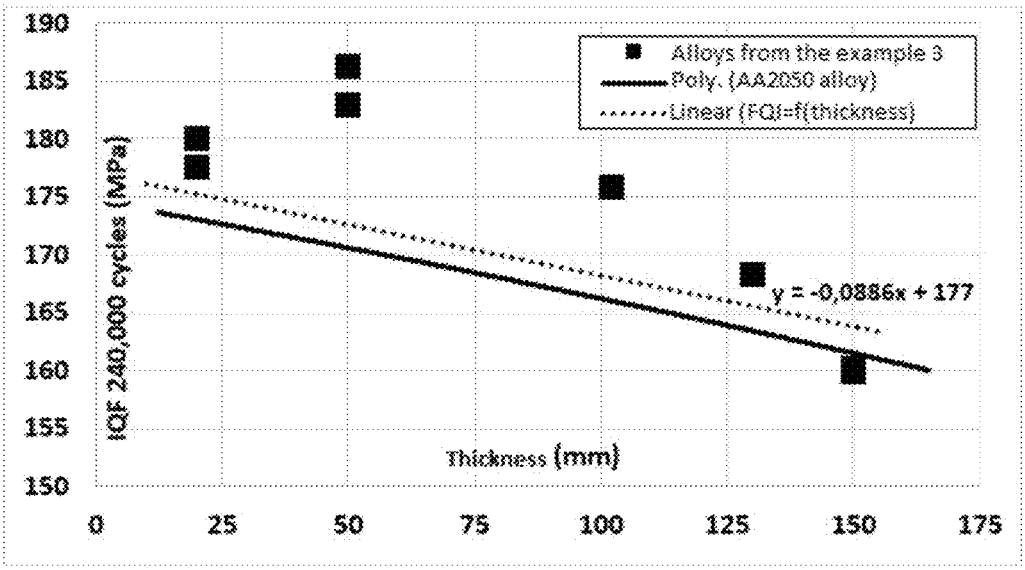
FIG. 4 shows the fatigue quality index FQI at 240,000 cycles, expressed in MPa, according to the thickness in mm of alloy sheets according to the example 3, the trend curve (polynomial regression) of the results obtained for products made from AA2050 alloy of the prior art is also shown in this figure.

The table 3 summarizes the scores assigned to the different samples. FIGS. 3 and 4 show micrographs obtained for the samples taken at mid-thickness (FIG. 3) and at a quarter-thickness (FIG. 4) of the cast ingots made of alloy A (FIGS. 3*b* and 4*b*), B (FIGS. 3*c* and 4*c*) and C (FIGS. 3*a* and 4*a*).

TABLE 3

Microstructure of the grains evaluated at mid-thickness (t/2) and at a quarter-thickness (t/4) of the cast ingots made of Al—Cu—Li alloys (score 0 = mostly globular grains, score 1 = grains slightly dendritic, score 2 = grains highly dendritic).

| Alloy | Microstructure (score) | |
|---|---|---|
| | t/2 | t/4 |
| A | 2 | 2 |
| B | 1 | 1 |
| C (2050) | 0 | 0 |

Ingots A and B have casting grains that are larger and more dendritic in relation to those of the ingot C.

Example 2

Certain cast ingots of example 1 were homogenized at 505° C. for about 12 hours then scalped. The ingots were hot rolled in order to obtain sheets having a thickness of 60 mm. They were solution heat treated at 527° C. and quenched with cold water. The sheets were then stretched with a permanent elongation of 3.7%.

The sheets were subjected to aging at 155° C. for about 20 h.

Samples were taken at a quarter-thickness (t/4) in order to measure the static mechanical characteristics in tensile in the directions L and TL and the toughness in the directions L-T and T-L, at mid-thickness (t/2) in order to measure the static mechanical characteristics in tensile in the direction TC and the toughness in the direction TC-L. The test pieces used for the measurement of toughness were test pieces with a geometry CT and had the following dimensions:

- directions L and TL/L-T and T-L, test pieces CT25: thickness B=25 mm, width W=50 mm;
- direction TC/TC-L, test pieces CT20: thickness B=20 mm, width W=40 mm.

The results obtained are presented in the tables 4 and 5.

TABLE 4

Static mechanical properties obtained for the different sheets.

| Alloy | Rp02 (MPa) | Rm (MPa) | A (%) | Rp02 (MPa) | Rm (MPa) | A (%) | Rp02 (MPa) | Rm (MPa) | A (%) |
|---|---|---|---|---|---|---|---|---|---|
| | Direction L | | | Direction TL | | | Direction TC | | |
| A | 513 | 537 | 11.8 | 490 | 531 | 10.1 | 461 | 528 | 6.3 |
| B | 511 | 539 | 11.1 | 491 | 533 | 10.1 | 465 | 532 | 5.7 |
| C (2050) | 490 | 516 | 10.7 | 473 | 513 | 10.1 | 451 | 513 | 5.5 |
| D (2050) | 492 | 518 | 11 | 484 | 525 | 9.4 | 448 | 514 | 7.5 |

TABLE 5

Properties of K1C toughness obtained for the different sheets.

| Alloy | K1C L-T (Mpa √m) | K1C T-L (Mpa √m) | K1C S-L (Mpa √m) |
|---|---|---|---|
| A | 44.9 | 35 | 33.6 |
| B | 42.9 | 32.5 | 31.7 |
| C (2050) | 46 | 36 | 28 |
| D (2050) | 40 | 31 | 28 |

Sheets A and B globally have a compromise in mechanical strength properties Rp0.2/K1C toughness that is improved with respect to that of sheets C and D made of 2050 alloy according to the prior art.

The fatigue properties were characterized on test pieces with a hole sampled at mid-thickness. FIG. 1 reproduces the test pieces used of which the value Kt is 2.3. The test pieces were tested at a frequency of 50 Hz in ambient air with a value R=0.1. The fatigue quality index FQI was calculated and is presented in the table 6.

TABLE 6

Results of the fatigue tests (test pieces with a hole)

| Alloy | FQI (MPa), 50% rupture for 240,000 cycles L-T | FQI (MPa), 50% rupture for 240,000 cycles T-L |
|---|---|---|
| A | 182 | 180 |
| B | 184 | 186 |
| D (2050) | 172 | 157 |

The sheets made of alloys A and B have improved fatigue properties with respect to sheet D.

Example 3

In this example, several ingots of a thickness of about 400 mm of which the composition is given in the table 7 were cast.

TABLE 7

Composition as a % by weight Al-Cu-Li cast in the form on an ingot.

| Alloy | Si | Fe | Cu | Mn | Mg | Zn | Ti | Zr | Li | Ag | V | Cr |
|---|---|---|---|---|---|---|---|---|---|---|---|---|
| E | 0.03 | 0.04 | 3.57 | 0.34 | 0.44 | 0.52 | 0.03 | 0.10 | 0.87 | 0.026 | 0.041 | — |
| F | 0.03 | 0.05 | 3.58 | 0.34 | 0.43 | 0.60 | 0.03 | 0.11 | 0.86 | 0.002 | 0.040 | — |
| G | 0.02 | 0.04 | 3.61 | 0.34 | 0.43 | 0.61 | 0.03 | 0.11 | 0.85 | 0.010 | 0.042 | — |
| H | 0.03 | 0.04 | 3.45 | 0.33 | 0.34 | 0.56 | 0.03 | 0.10 | 0.86 | 0.079 | 0.038 | — |
| I | 0.02 | 0.05 | 3.55 | 0.34 | 0.33 | 0.60 | 0.03 | 0.10 | 0.93 | 0.110 | 0.039 | — |
| J | 0.02 | 0.04 | 3.55 | 0.34 | 0.33 | 0.60 | 0.03 | 0.11 | 0.87 | 0.090 | 0.039 | — |

The ingots were homogenized at 505° C. for 12 hours then scalped. They were hot rolled until a final thickness of 20 and 50 mm (sheet made from alloys E and J), or 102 and 130 mm (sheet made from alloy G) or 150 mm (sheet made from alloys F and I) then were solution heat treated at 527° C. and quenched with cold water. The sheets were then stretched with a permanent elongation of 6% and have undergone aging at 150° C. for about 20 h.

The fatigue properties were characterized on test pieces with a hole sampled at mid-thickness. FIG. 3 reproduces the test pieces used of which the value Kt is 2.3. The test pieces were tested at a frequency of 50 Hz in ambient air with a value R=0.1. The fatigue quality index FQI was calculated. The results are presented in FIG. 4 and compared to the trend curve (polynomial regression) of the results obtained for products made from AA2050 alloy of the prior art, with this alloy being free from V and from Cr (V and Cr<0.005% by weight).

Example 4

In this example, the alloy G of the example 2 was transformed as indicated hereinabove (thickness 102 mm) except for the final step of aging. An aging kinetics was carried out for this example and the results are compared with those obtained for the alloy K (composition detailed in the table 8 hereinbelow) transformed in the same conditions.

TABLE 8

| Composition as a % by weight Al-Cu-Li cast in the form of an ingot. | | | | | | | | | | | | |
|---|---|---|---|---|---|---|---|---|---|---|---|---|
| Alloy | Si | Fe | Cu | Mn | Mg | Zn | Ti | Zr | Li | Ag | V | Cr |
| K | 0.02 | 0.04 | 3.62 | 0.36 | 0.43 | 0.56 | 0.031 | 0.10 | 0.90 | 0.01 | — | — |

The aging conditions studied were as follows: 150° C. for 20, 25 or 30 h (alloy G) and 20, 30, 40 and 50 h (alloy K).

Figure 5:
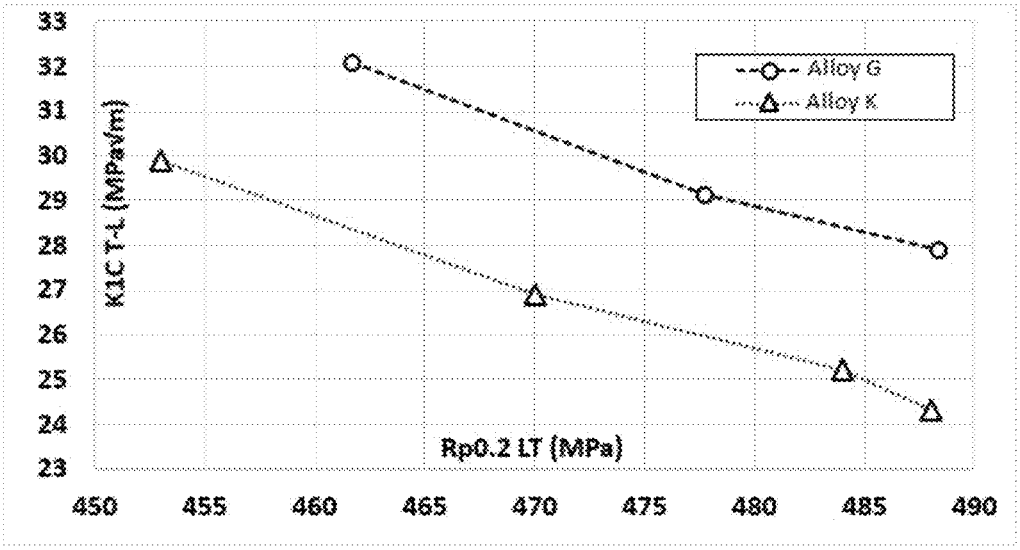
FIG. 5 represents the compromise between K1C (T-L), expressed in MPa√m, and Rp0.2 (LT), expressed in MPa, obtained according to the aging kinetics of the example 4 for the alloys G and K.

The mechanical characteristics and the toughnesses of the final products were evaluated and are presented in FIG. 5.

In order to measure the static mechanical characteristics in tensile, samples were taken at a quarter-thickness (T/4) in order to measure these characteristics in the direction L.

In order to measure the toughness, samples were taken at a quarter-thickness (T/4) in order to measure these characteristics in the direction T-L. The test pieces used for the measurement of toughness were test pieces with a geometry CT40: thickness B=40 mm, width W=80 mm.

Example 5

The microstructure at mid-thickness (t/2) and at quarter-thickness (t/4) of sheets of examples 1 and 3 was studied by scanning electron microscopy in order to determine the density of the intermetallic phases on the micrometric scale.

The density (number of phases per $mm^2$) of the intermetallic phases is detailed in table 9.

TABLE 9

| Density (number per $mm^2$) of the intermetallic phases | | | |
|---|---|---|---|
| | Intermetallic phases (number per $mm^2$) | | |
| Alloy | t/4 | t/2 | Average density in the thickness |
| A | 130.8 | 127.6 | 129.2 |
| B | 124.3 | 120.7 | 122.5 |
| C | 161.0 | 154.6 | 157.8 |
| E | 144.6 | 145.1 | 144.8 |
| F | 148.5 | 159.3 | 153.9 |
| G | 159.9 | 144.9 | 152.4 |

Figure 6:
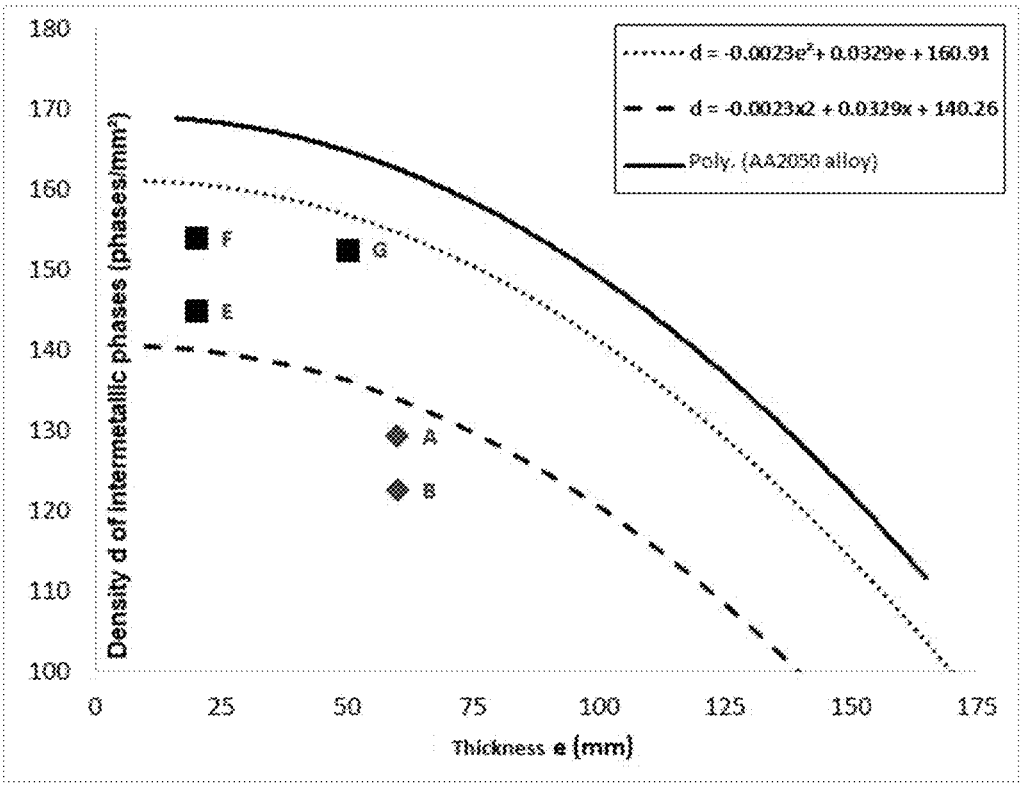
FIG. 6 represents the average density of intermetallic phases (number of phases/$mm^2$) according to the thickness e, expressed in mm, of the sheets according to the invention. The trend curve (polynomial regression) of the results obtained for produced made from AA2050 from prior art is also shown in this figure.

FIG. 6 shows the average density of intermetallic phases (number of phases/$mm^2$) according to the thickness e, expressed in mm, of the sheets according to the invention, the trend curve (polynomial regression) of the results obtained for products made from AA2050 alloy of the prior art is also shown in this figure, the AA2050 alloy being free from V and from Cr (V and Cr<0.005% by weight).

Example 6

Ingots of which the composition is given in the Table 10 were cast.

TABLE 10

| Composition as a % by weight Al-Cu-Li cast in the form of an ingot. | | | | | | | | | | | | |
|---|---|---|---|---|---|---|---|---|---|---|---|---|
| Alloy | Si | Fe | Cu | Mn | Mg | Zn | Ti | Zr | Li | Ag | V | Cr |
| L | 0.03 | 0.05 | 3.48 | 0.38 | 0.35 | 0.62 | 0.031 | 0.08 | 0.89 | 0.10 | — | — |
| M | 0.03 | 0.04 | 3.53 | 0.38 | 0.37 | 0.61 | 0.032 | 0.08 | 0.91 | 0.12 | 0.040 | — |
| N | 0.03 | 0.04 | 3.52 | 0.36 | 0.35 | 0.58 | 0.031 | 0.09 | 0.88 | 0.10 | 0.040 | — |

The ingots were homogenized 12 h at 505° C. then 12 h at 525° C. then scalped. The ingots were hot rolled in order to obtain sheets having a thickness of 130 mm. They were solution heat treated at 517° C. and quenched with cold water. The sheets were then stretched with a permanent elongation of 3.7%.

The sheets were subjected to aging at 155° C. for about 20 h.

Samples were taken at a quarter-thickness (t/4) in order to measure the static mechanical characteristics in tensile in the directions L and TL and the toughness in the directions L-T and T-L, at mid-thickness (t/2) in order to measure the static mechanical characteristics in tensile in the direction TC and the toughness in the direction TC-L. The test pieces used for the measurement of toughness were test pieces with a geometry CT and had the following dimensions:

directions L and TL/L-T and T-L, test pieces CT25: thickness B=25 mm, width W=50 mm;

direction TC/TC-L, test pieces CT20: thickness B=20 mm, width W=40 mm.

The results obtained are presented in the tables 11 and 12.

TABLE 11

| Static mechanical properties obtained for the different sheets. | | | | | | |
|---|---|---|---|---|---|---|
| | Rp02 (MPa) | Rm (MPa) | Rp02 (MPa) | Rm (MPa) | Rp02 (MPa) | Rm (MPa) |
| Alloy | Direction L | | Direction TL | | Direction TC | |
| L | 478 | 503 | 467 | 512 | 447 | 504 |
| M | 482 | 509 | 471 | 516 | 448 | 502 |
| N | 478 | 503 | 466 | 511 | 448 | 503 |

TABLE 12

Properties of K1C toughness obtained for the different sheets.

| Alloy | K1C L-T (MPa √m) | K1C T-L (MPa √m) | K1C S-L (MPa √m) |
|---|---|---|---|
| L | 31.7 | 26.1 | 24.7 |
| M | 34.1 | 27.2 | 26.2 |
| N | 34.6 | 27.9 | 27.7 |

Sheets M and N globally have a compromise in mechanical strength properties Rp0.2/K1C toughness that is improved with respect to that of the sheet L.

The invention claimed is:

1. A rolled, extruded and/or forged 2XXX alloy product having a thickness of 30 to 110 mm with an aluminum base comprising, by weight, from 0.80 to 0.95% Li, from 0.025 to 0.041% Cr and/or V, from 3.2 to 4.0% Cu, from 0.15 to 0.7% Mg, from 0.07 to 0.15% Zr, from 0 to 0.6% Mn, <0.8% Zn, from 0 to 0.5% Ag, Fe+Si≤0.2%, and at least one element that contributes to control of grain size, selected from Hf, Ti, Sc, and other rare earth elements, wherein Hf if present is at from 0.02 to 0.5%, Ti if present is at from 0.01 to 0.15%, and Sc if present is at from 0.02% to 0.1%; wherein the density of dispersoids with Cr and/or V is less than 0.1 dispersoid per $\mu m^2$.

2. The product according to claim 1 having an average density d of intermetallic phases, expressed as a number of phases per $mm^2$, such that:

$$d<-0.0023e^2+0.0329e+160.91$$

with e=thickness of the product in mm.

3. The product according to claim 1 comprising from 0.08 to 0.10% by weight of Zr.

4. The product according to claim 1 comprising from 0.038 to 0.041% by weight of Cr and/or of V.

5. The product according to claim 1 containing no dispersoids with V and/or Cr.

6. The product according to claim 1 of which the thickness is from 40 to 110 mm.

7. The product according to claim 1 in a rolled state, solution heat treatment, quenched temper, stress relieved, optionally by stretching, and aged having, for thicknesses between 30 and 110 mm, a fatigue quality index, FQI, at 240,000 cycles expressed in MPa such that:

$$FQI>-0.0886e+177$$

with e=thickness of the product in mm.

8. The product according to claim 1, wherein the product is in a rolled state, solution heat treated, quenched tempered, stress relieved, and aged, wherein the product according to claim 1 has at least one of the following improved properties:

Rp0.2 (L) and K1C (L–T),

Rp0.2 (TL) and K1C (T–L)

Rp0.2 (TC) and K1C (TC–L)

where the improved properties are as compared with respect to an alloy product having the same composition as the product of claim 1, but not comprising from 0.025 to 0.041% by weight of Cr or V.

9. An aircraft structural element, comprising the product according to claim 1.

10. An aircraft structural element comprising at least one skin and at least one stiffener, wherein the at least one skin and at least one stiffener are each made from the same product according to claim 1.

* * * * *